US009695700B2

(12) United States Patent
Haydn-Smith et al.

(10) Patent No.: US 9,695,700 B2
(45) Date of Patent: Jul. 4, 2017

(54) LOCK PLATE

(71) Applicant: ROLLS-ROYCE PLC, London (GB)

(72) Inventors: Simon Kenneth Haydn-Smith, Bristol (GB); Mikel Villaro, Vizcaya (ES)

(73) Assignee: ROLLS-ROYCE plc, London (GB)

( * ) Notice: Subject to any disclaimer, the term of this patent is extended or adjusted under 35 U.S.C. 154(b) by 353 days.

(21) Appl. No.: 14/226,073

(22) Filed: Mar. 26, 2014

(65) Prior Publication Data

US 2014/0356175 A1 Dec. 4, 2014

(30) Foreign Application Priority Data

May 31, 2013 (GB) ..... 1309722.5

(51) Int. Cl.
*F01D 5/32* (2006.01)
*F01D 5/30* (2006.01)

(52) U.S. Cl.
CPC ..... *F01D 5/323* (2013.01); *F01D 5/3015* (2013.01); *F05D 2230/70* (2013.01); *F05D 2250/711* (2013.01); *F05D 2260/30* (2013.01); *Y10T 29/49318* (2015.01)

(58) Field of Classification Search
CPC ..... F01D 5/30; F01D 5/3007; F01D 5/3015; F01D 5/32; F01D 5/323; F01D 5/326; F01D 11/006; F01D 11/008; F01D 11/001; Y10T 403/553; Y10T 403/551; Y10T 403/55; F16B 3/04
See application file for complete search history.

(56) References Cited

U.S. PATENT DOCUMENTS 2,641,443 A 6/1953 Comery et al.
3,043,562 A * 7/1962 Fusner ..... F01D 5/3015 416/193 A
3,598,503 A * 8/1971 Muller ..... F01D 5/323 416/221

(Continued)

FOREIGN PATENT DOCUMENTS

DE 1 288 364 1/1969
EP 0 609 979 A1 8/1994

(Continued)

OTHER PUBLICATIONS

European Search Report issued in European Patent Application No. EP 14 16 1664 on Oct. 2, 2014.

(Continued)

*Primary Examiner* — Jonathan Masinick
(74) *Attorney, Agent, or Firm* — Oliff PLC

(57) ABSTRACT

A lock plate for preventing relative movement between a first component and an adjoining second component, comprises a first end, a second end, and a planar portion extending between the first end and the second end.
The first end is configured to locate against one of the first component and the second component, while the second end is configured to locate against the other one of the first component and the second component.
The planar portion comprises a first projection positioned substantially mid-way between the first end and the second end. The first projection protrudes from a plane defined by the planar portion and may readily be severed by a user to thereby separate the first and second component from one another.

12 Claims, 5 Drawing Sheets

(56) References Cited

U.S. PATENT DOCUMENTS

| | | | | |
|---|---|---|---|---|
| 4,767,276 | A | 8/1988 | Barnes et al. | |
| 5,256,035 | A | 10/1993 | Norris et al. | |
| 5,662,458 | A | 9/1997 | Owen | |
| 6,065,932 | A | 5/2000 | Dodd | |
| 6,837,686 | B2 * | 1/2005 | Di Paola | F01D 5/323 416/220 R |
| 2005/0123405 | A1 | 6/2005 | Ono et al. | |
| 2006/0239822 | A1 | 10/2006 | Wulf | |
| 2007/0217904 | A1 | 9/2007 | Dixon et al. | |
| 2009/0092497 | A1 | 4/2009 | Boeck | |
| 2009/0116965 | A1 | 5/2009 | Brillert et al. | |
| 2010/0074732 | A1 * | 3/2010 | Marra | F01D 5/025 415/173.4 |
| 2013/0202433 | A1 * | 8/2013 | Hafner | F01D 5/3015 415/230 |

FOREIGN PATENT DOCUMENTS

| | | | |
|---|---|---|---|
| EP | 1 057 973 | A2 | 12/2000 |
| EP | 1 650 406 | A2 | 4/2006 |
| EP | 1 916 389 | A1 | 4/2008 |

OTHER PUBLICATIONS

Nov. 18, 2013 Search Report issued in British Application No. GB1309722.5.

* cited by examiner

LOCK PLATE

FIELD OF THE INVENTION

The present invention relates to a lock plate, and particularly, but not exclusively, to a lock plate for maintaining the relative orientation of two adjoining s components.

BACKGROUND TO THE INVENTION

It is known for gas turbine compressor and turbine blades to be securely retained axially in their respective discs. A typical method of providing blade axial retention is by the use of lock plates 10 and 'pre-bents' 12 as shown in FIG. 1.

In such arrangements, the assembly method begins with the blades 20 being located sequentially within the disc 30. Some blades are then advanced forward in the disc to provide space for a number of lock plates 10 to be rotated into place between the blade rim and the disc 30. The blades 20 are then positioned and lock plates 10 evenly distributed around the disc 30. The remaining spaces are filled with 'pre-bents' 12 which are then hammered flat to secure them in place.

During disassembly of the bladed disc the 'pre-bents' 12 are removed by accessing the front of the assembled disc 30 and passing tooling between the blades 20 to buckle the 'pre-bents' 12 rearwards. These buckled 'pre-bents' 12 are then removed allowing space to spiral some of the blades down and thereby reverse the assembly procedure A significant problem with this technique is that access is required to the front of the disc 20 in order to be able to buckle the 'pre-bents' 12 rearwards and remove them from the disc 20. In a multi-stage turbine system this will not be possible and therefore alternative methods of disassembly, such as cutting the lock plates 10, must be used. Such alternative methods carry a significant risk of damaging the high value disc 30 and blades 20.

STATEMENTS OF INVENTION

According to a first aspect of the present invention there is provided a lock plate for preventing relative movement between a first component and an adjoining second component, the lock plate comprising:

- a first end, located against one of the first component and the second component;
- a second end, located against the other one of the first component and the second component; and
- a planar portion extending between the first end and the second end, wherein the planar portion comprises a first projection positioned substantially mid-way between the first end and the second end, the first projection protruding from a plane defined by the planar portion.

The first projection of the lock plate may be readily severed using a shrouded cutting tool without requiring access to the front of the disc assembly. This makes the use of the lock plate of the invention convenient and cost effective for a user.

Optionally, the first projection protrudes normal to the plane of the planar portion by a distance at least equal to a thickness of the planar portion itself.

The first projection of the lock plate may be readily severed using a shrouded cutting tool in which the depth of cut is slightly deeper than the thickness of the first projection of the lock plate. This ensures that the cutting tool is unable to contact the high value disc and blades. This in turn makes the lock plate of the invention convenient for a user and removes the risk of damaging the costly disc and blades Optionally, the planar portion comprises a second projection extending laterally between opposing side edges of the planar portion.

This arrangement makes the lock plate simple and cost effective to produce by conventional sheet metal fabrication techniques.

Optionally, the second projection extends linearly across a width of the planar portion.

This makes the process of severing the first projection of the lock plate simple and straightforward for a user because the cutting process need only extend linearly.

Optionally, the second projection is oriented substantially normally to at least one of the opposing side edges of the planar portion.

This results in the first projection being aligned substantially tangentially to a circumference of the assembled disc. This in turn makes the process of severing the first projection of the lock plate easier and more convenient for a user because the path of the cutting tool may easily and conveniently be arranged to follow this circumferential path.

Optionally, a thickness of the first projection is less than a thickness of the planar portion at one of the first end and second end.

This makes the process of severing the first projection easier and more convenient for a user because less material needs to be cut through.

Optionally, the first end comprises a lip portion, the lip portion extending out of the plane defined by the planar portion in the same direction as the first projection.

The lip portion engages with a corresponding part of the first component to thereby locate the first component in a pre-defined position relative to the second component.

Optionally, the first projection includes a radiussed cross-sectional profile.

Forming the first projection of the lock plate with a radiussed cross-sectional profile makes the lock plate easier and therefore more cost effective to manufacture using conventional sheet metal forming techniques.

Optionally, the first projection is provided with a groove or ridge to thereby aid the visual location of the first projection.

This feature makes the identification of the lock plate easier for a user particularly in arrangements in which visual inspection of the lock plates is difficult, for example in a multi-stage turbine system having several rows of blades.

According to a second aspect of the present invention there is provided a method of dismantling an assembly, the assembly comprising a first component and a second component that are located relative to one another by a lock plate, the lock plate having a first end and an opposite second end, and a first projection at a mid-point therebetween, the method comprising the steps of:

(a) severing the lock plate along the first projection;
(b) extracting the severed portions of the lock plate from the assembly; and
(c) separating the first component from the second component.

The method of the invention simplifies the process of dismantling two components that have been located relative to one another by means of a lock plate, by severing the lock plate.

Optionally, the first projection is provided with a groove or ridge, with step (a) comprising the initial step of:

(a') visually locating the first projection by means of the groove or ridge.

Other aspects of the invention provide devices, methods and systems which include and/or implement some or all of the actions described herein. The illustrative aspects of the invention are designed to solve one or more of the problems herein described and/or one or more other problems not discussed.

BRIEF DESCRIPTION OF THE DRAWINGS

There now follows a description of an embodiment of the invention, by way of non-limiting example, with reference being made to the accompanying drawings in which.

It is noted that the drawings may not be to scale. The drawings are intended to depict only typical aspects of the invention, and therefore should not be considered as limiting the scope of the invention. In the drawings, like numbering represents like elements between the drawings.

DETAILED DESCRIPTION

Figure 1:
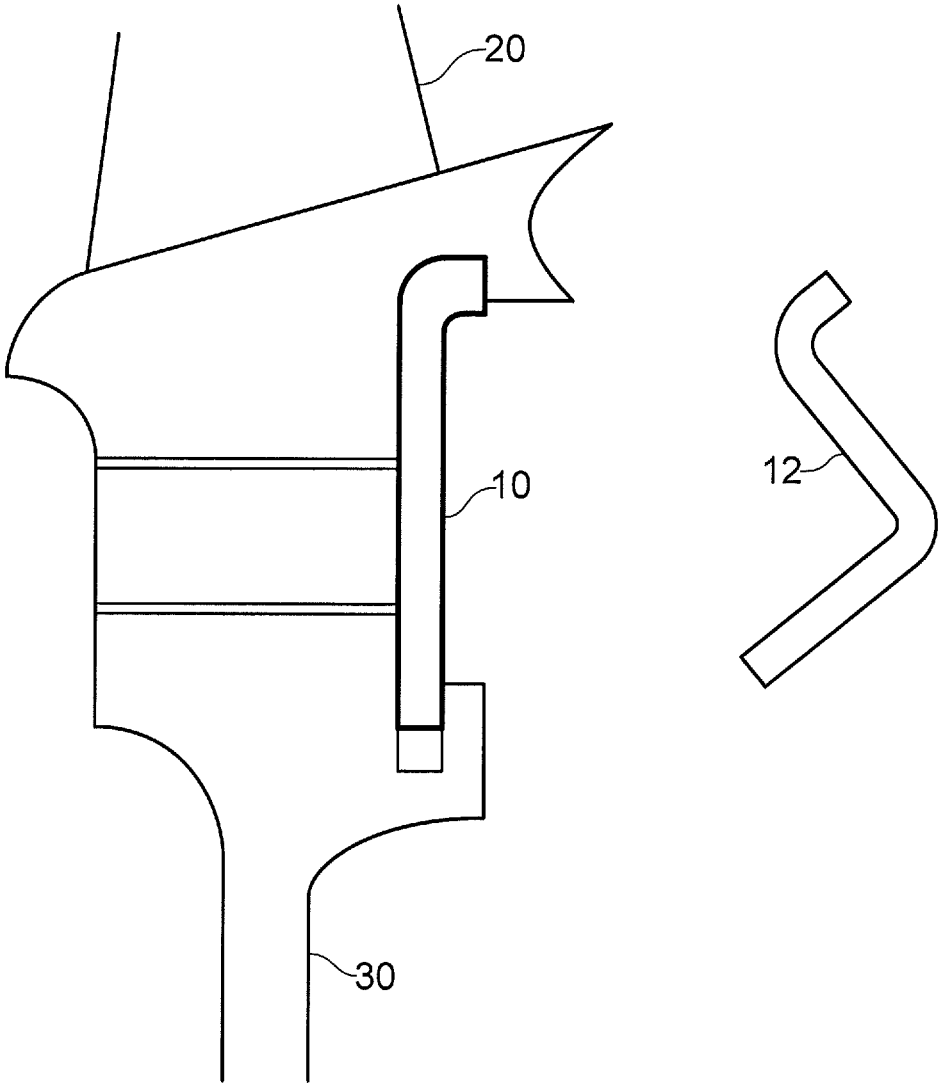
FIG. 1 (Prior Art)
FIG. 1 shows a schematic sectional view of a lock plate assembly according to the prior art.
Figure 2:
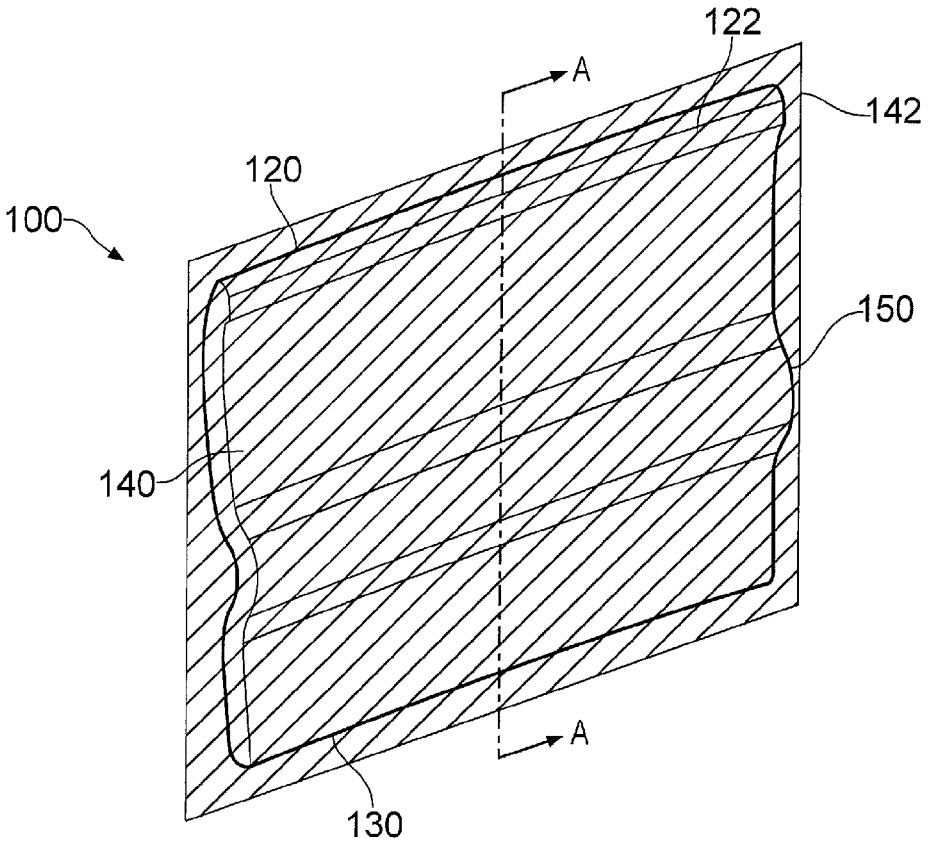
FIG. 2 shows a perspective view of a lock plate according to a first embodiment of the invention.
Figure 3:
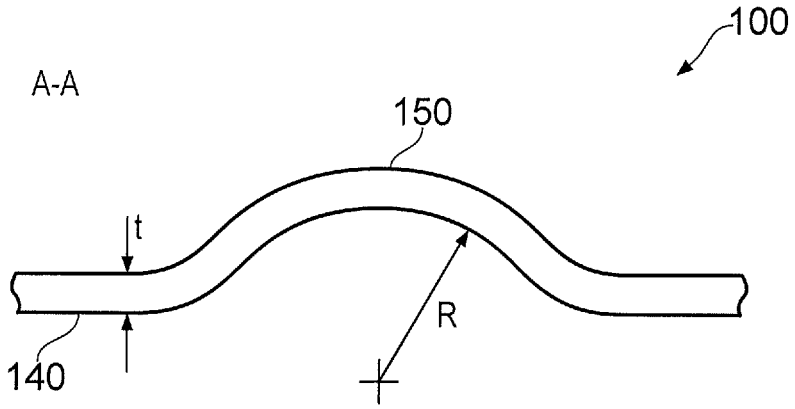
FIG. 3 shows a schematic sectional view of a lock plate according to the present invention.

Referring to FIGS. 2 and 3, a lock plate according to a first embodiment of the invention is designated generally by the reference numeral 100.

The lock plate 100 comprises a first end 120 and an opposite second end 130, with a planar portion 140 extending between the first end 120 and the second end 130.

The planar portion 140 comprises a first projection 150 that is positioned substantially mid-way between the first end 120 and the second end 130. The first projection 150 protrudes from a plane 142 that is defined by the planar portion 140.

The first projection 150 protrudes from the plane 142 of the planar portion 140 by a distance that is at least equal to a thickness of the planar portion 140.

The first end 120 comprises a lip portion 122 that extends out of the plane 142 defined by the planar portion 140 in the same direction as the first projection 150.

FIG. 3 shows a cross-section through the lock plate 100 of FIG. 2. The planar portion 140 has a constant thickness t across the first projection 150.

In the present embodiment the lock plate 100 is formed from a metal plate such as, for example, steel or a titanium alloy. The lock plate 100 can be readily formed using conventional metal sheet or plate forming techniques.

Figure 4:
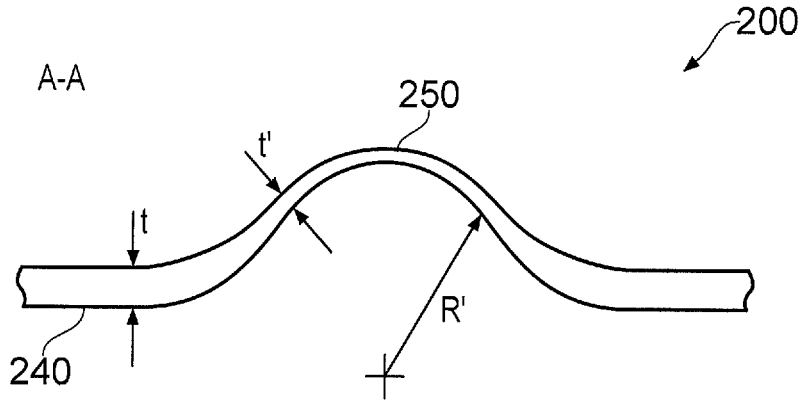
FIG. 4 shows a schematic sectional view of a lock plate according to a second embodiment of the present invention.

Referring to FIG. 4, a lock plate according to a second embodiment of the invention is designated generally by the reference numeral 200. Features of the lock plate 200 which correspond to those of lock plate 100 have been given corresponding reference numerals for ease of reference.

The lock plate 200 has a first end 120 and an opposite second end 130, with a planar portion 240 extending between the first end 120 and the second end 130.

The planar portion 240 comprises a first projection 250 that is positioned substantially mid-way between the first end 120 and the second end 130. The first projection 250 protrudes from a plane 142 that is defined by the planar portion 240.

In this embodiment the planar portion 240 that lies in the plane 142 has a thickness t. However, the first projection 250 is thinned relative to the planar portion 240, and has a thickness t', where t' is less than t.

Figure 5:
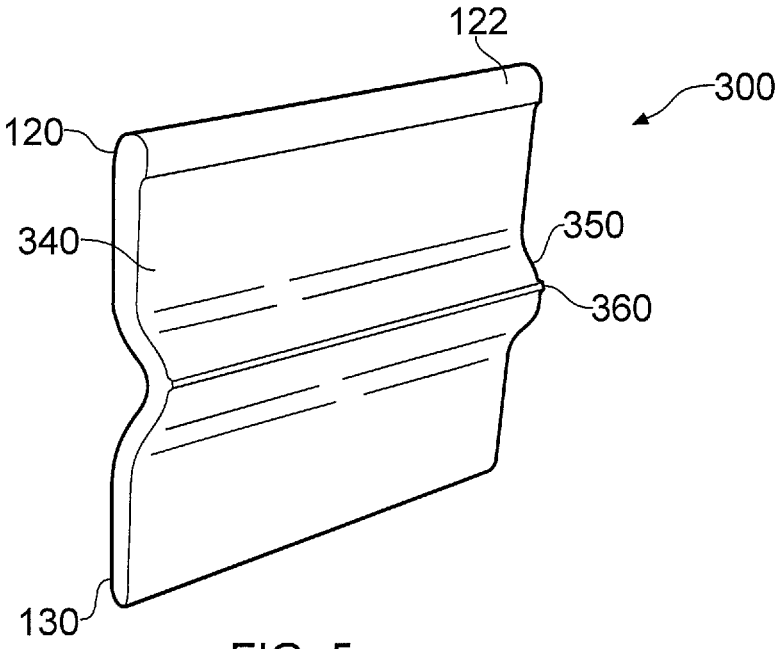
FIG. 5 shows a perspective view of a lock plate according to a third embodiment of the invention.

Referring to FIG. 5, a lock plate according to a third embodiment of the invention is designated generally by the reference numeral 300. Features of the lock plate 300 which correspond to those of lock plate 100 have been given corresponding reference numerals for ease of reference.

The lock plate 300 has a first end 120 and an opposite second end 130, with a planar portion 340 extending between the first end 120 and the second end 130.

The planar portion 340 comprises a first projection 350 that is positioned substantially mid-way between the first end 120 and the second end 130. The first projection 350 protrudes from a plane 142 (shown in FIG. 2) that is defined by the planar portion 340.

In this embodiment the first projection 350 includes a second projection 360 that extends along the length of the first projection 350 in a direction distal to the plane 142.

Figure 6:
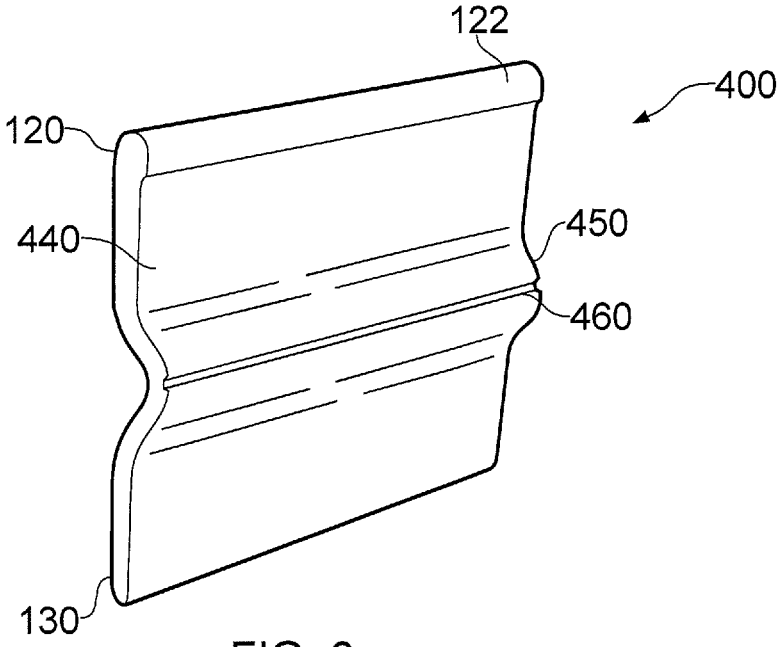
FIG. 6 shows a perspective view of a lock plate according to a fourth embodiment of the invention.

Referring to FIG. 6, a lock plate according to a fourth embodiment of the invention is designated generally by the reference numeral 400. Features of the lock plate 400 which correspond to those of lock plate 100 have been given corresponding reference numerals for ease of reference.

As with the aforementioned embodiments, the lock plate 400 has a first end 120 and an opposite second end 130, with a planar portion 440 extending between the first end 120 and the second end 130.

The planar portion 440 comprises a 450 that is positioned substantially mid-way between the first end 120 and the second end 130. The first projection 450 protrudes from a plane 142 that is defined by the planar portion 440.

However, in this embodiment the first projection 450 includes a groove 460 that extends along the length of the first projection 450 in a direction distal to the plane 142.

Figure 7B:
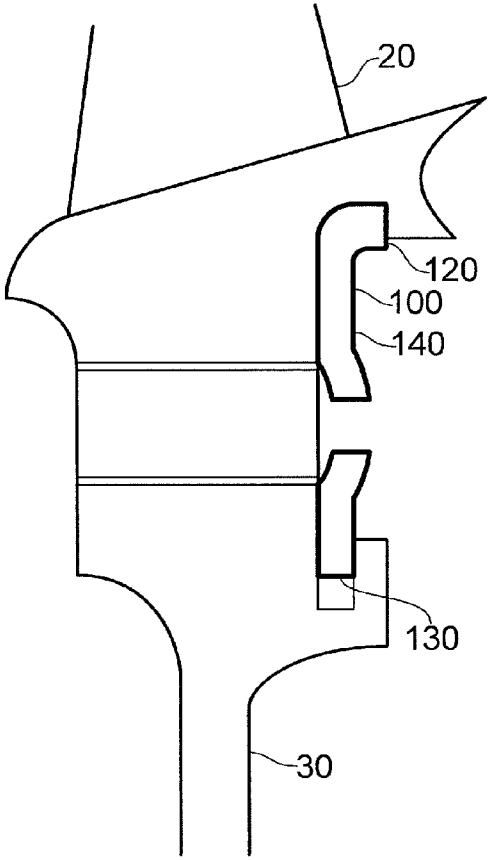
FIGS. 7A and 7B show the lock plate assembly of FIG. 3 with the lock plate having been severed.
Figure 7A:
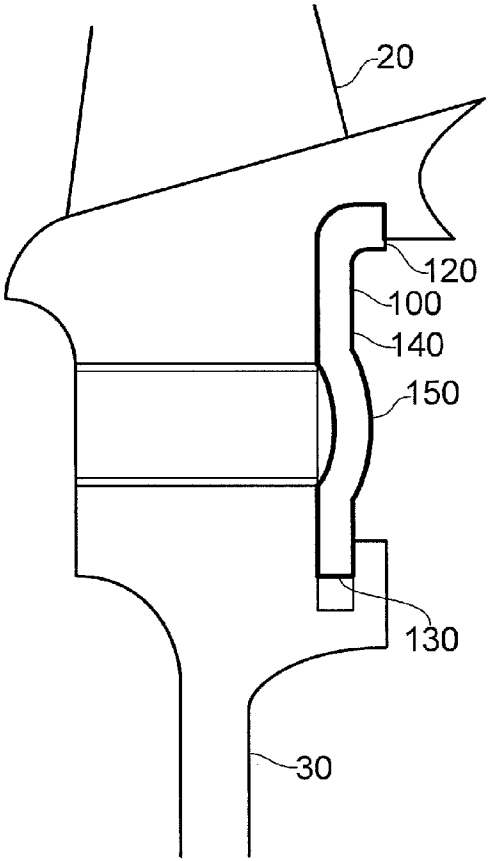

In use, as shown in FIGS. 7A and 7B, a first component 20 and a second component 30 are aligned with one another and their relative position is fixed by means of a plurality of lock plates 100. In this arrangement, the first component 20 is a turbine blade 20 and the second component is turbine disc 30.

The assembled turbine blade 20 and turbine disc 30 may be disassembled by severing the first projection 150 of the lock plate 100. The severed parts of the lock plate 100 can be seen in FIG. 7B.

These severed parts may then be removed from their position in the assembly, thus freeing the turbine blade 20 from the turbine disc 30.

Although FIGS. 7A and 7B show the use of a lock plate according to the first embodiment of the invention, the method of use of the invention applies equally to any of the embodiments of the invention described hereinabove.

The present invention may be embodied in other specific forms without departing from its spirit or essential characteristics. The described embodiments are to be considered in all respects only as illustrative and not restrictive. The scope of the invention is therefore indicated by the appended claims rather than by the foregoing description. All changes which come within the meaning and range of equivalency of the claims are to be embraced within their scope.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person of skill in the art are included within the scope of the invention as defined by the accompanying claims.

The invention claimed is:

1. A lock plate for preventing relative movement between a first component and an adjoining second component, the lock plate comprising:

a first end, located against one of the first component and the second component;

a second end, located against the other one of the first component and the second component; and a planar portion extending between the first end and the second end, the planar portion comprising a serpentine radial cross-section forming a first projection, the first projection being (i) positioned substantially mid-way between the first end and the second end and extending laterally between opposing side edges of the planar portion, (ii) formed by a serpentine deformation of the planar portion protruding from a plane defined by the planar portion, and (iii) provided with a groove or ridge to thereby aid a visual location of the first projection, the groove or ridge being disposed on the first projection from a first point to a second point along a midpoint of the first projection, extending laterally between opposing side edges of the planar portion.

2. The lock plate as claimed in claim 1, wherein the first projection protrudes normal to the plane of the planar portion by a distance at least equal to a thickness of the planar portion itself.

3. The lock plate as claimed in claim 1, wherein the planar portion comprises a second projection extending laterally between opposing side edges of the planar portion.

4. The lock plate as claimed in claim 3, wherein the second projection extends linearly across a width of the planar portion.

5. The lock plate as claimed in claim 3, wherein the second projection is oriented substantially normally to at least one of the opposing side edges of the planar portion.

6. The lock plate as claimed in claim 1, wherein a thickness of the first projection is less than a thickness of the planar portion at one of the first end and second end.

7. The lock plate as claimed in claim 1, wherein the first end comprises a lip portion, the lip portion extending out of the plane defined by the planar portion in the same direction as the first projection.

8. The lock plate as claimed in claim 1, wherein the first projection includes a radiussed cross-sectional profile.

9. A method of dismantling an assembly, the assembly comprising a first component and a second component that are located relative to one another by a lock plate, the lock plate having a first end and an opposite second end, and a planar portion extending between the first end and the second end, the planar portion comprising a serpentine radial cross-section forming a first projection, the first projection being (i) positioned substantially mid-way between the first end and the second end and extending laterally between opposing side edges of the planar portion, and (ii) formed by a serpentine deformation of the planar portion protruding from a plane defined by the planar portion, the method comprising:

(a) severing the lock plate along the first projection;

(b) extracting the severed portions of the lock plate from the assembly; and (c) separating the first component from the second component, with the proviso that:

(I) the first projection is provided with a groove or ridge to thereby aid a visual location of the first projection, the groove or ridge being disposed on the first projection from a first point to a second point along a midpoint of the first projection, extending laterally between opposing side edges of the planar portion, (II) the planar portion comprises a second projection disposed on the first projection from the first point to the second point along the midpoint of the first projection, extending laterally between the opposing side edges of the planar portion, or (III) a thickness of the first projection is less than a thickness of the planar portion at one of the first end and second end, the thickness of the first projection gradually reduces from the planar portion at one of the first end and second end to the midpoint of the first projection.

10. The method as claimed in claim 9, wherein the first projection is provided with the groove or ridge, and step (a) comprises an initial step of (a') visually locating the first projection by means of the groove or ridge.

11. A lock plate for preventing relative movement between a first component and an adjoining second component, the lock plate comprising:

a first end, located against one of the first component and the second component;

a second end, located against the other one of the first component and the second component; and a planar portion extending between the first end and the second end, the planar portion comprising a serpentine radial cross-section forming a first projection, the first projection being (i) positioned substantially mid-way between the first end and the second end and extending laterally between opposing side edges of the planar portion, and (ii) formed by a serpentine deformation of the planar portion protruding from a plane defined by the planar portion, wherein the planar portion comprises a second projection disposed on the first projection from a first point to a second point along a midpoint of the first projection, extending laterally between opposing side edges of the planar portion.

12. A lock plate for preventing relative movement between a first component and an adjoining second component, the lock plate comprising:

a first end, located against one of the first component and the second component;

a second end, located against the other one of the first component and the second component; and a planar portion extending between the first end and the second end, the planar portion comprising a serpentine radial cross-section forming a first projection, the first projection being (i) positioned substantially mid-way between the first end and the second end and extending laterally between opposing side edges of the planar portion, and (ii) formed by a serpentine deformation of the planar portion protruding from a plane defined by the planar portion, wherein a thickness of the first projection is less than a thickness of the planar portion at one of the first end and second end, the thickness of the first projection gradually reduces from the planar portion at one of the first end and second end to a midpoint of the first projection.

* * * * *